US008043655B2

(12) United States Patent
Miller et al.

(10) Patent No.: US 8,043,655 B2
(45) Date of Patent: Oct. 25, 2011

(54) LOW-ENERGY METHOD OF MANUFACTURING BULK METALLIC STRUCTURES WITH SUBMICRON GRAIN SIZES

(75) Inventors: Steven A. Miller, Canton, MA (US); Prabhat Kumar, Framingham, MA (US)

(73) Assignee: H.C. Starck, Inc., Newton, MA (US)

( * ) Notice: Subject to any disclaimer, the term of this patent is extended or adjusted under 35 U.S.C. 154(b) by 356 days.

(21) Appl. No.: 12/245,840

(22) Filed: Oct. 6, 2008

(65) Prior Publication Data

US 2010/0086800 A1 Apr. 8, 2010

(51) Int. Cl.
*B05D 1/12* (2006.01)

(52) U.S. Cl. ..... 427/191; 419/6; 419/8; 427/180; 427/421.1

(58) Field of Classification Search ..... 419/8, 6; 427/180, 191, 421.1
See application file for complete search history.

(56) References Cited

U.S. PATENT DOCUMENTS

| | | | |
|---|---|---|---|
| 3,990,784 | A | 11/1976 | Gelber |
| 4,011,981 | A | 3/1977 | Danna et al. |
| 4,073,427 | A | 2/1978 | Keifert et al. |
| 4,140,172 | A | 2/1979 | Corey |
| 4,202,932 | A | 5/1980 | Chen et al. |
| 4,291,104 | A | 9/1981 | Keifert |
| 4,459,062 | A | 7/1984 | Siebert |
| 4,483,819 | A | 11/1984 | Albrecht et al. |
| 4,508,563 | A | 4/1985 | Bernard et al. |
| 4,537,641 | A | 8/1985 | Albrecht et al. |
| 4,722,756 | A | 2/1988 | Hard |
| 4,731,111 | A | 3/1988 | Kopatz et al. |
| 4,818,629 | A | 4/1989 | Jenstrom et al. |
| 4,915,745 | A | 4/1990 | Pollock et al. |
| 4,964,906 | A | 10/1990 | Fife |
| 5,091,244 | A | 2/1992 | Biornard |
| 5,242,481 | A | 9/1993 | Kumar |
| 5,270,858 | A | 12/1993 | Dickey |
| 5,302,414 | A | 4/1994 | Alkhimov et al. |
| 5,305,946 | A | 4/1994 | Heilmann |
| 5,580,516 | A | 12/1996 | Kumar |
| 5,612,254 | A | 3/1997 | Mu et al. |
| 5,679,473 | A | 10/1997 | Murayama et al. |
| 5,693,203 | A | 12/1997 | Ohhashi et al. |
| 5,795,626 | A | 8/1998 | Gabel et al. |

(Continued)

FOREIGN PATENT DOCUMENTS

DE 10253794 A1 6/2004

(Continued)

OTHER PUBLICATIONS

"Cold Gas Dynamic Spray CGSM Apparatus," Tev Tech LLC, available at: http://www.tevtechllc.com/cold_gas.html (accessed Dec. 14, 2009).

(Continued)

*Primary Examiner* — Roy King
*Assistant Examiner* — Ngoclan Mai
(74) *Attorney, Agent, or Firm* — Bingham McCutchen LLP

(57) ABSTRACT

Three dimensionally large metallic structures comprised of submicron grain sizes are produced by a process which includes directing a supersonic powder jet against a substrate such that the powder adheres to the substrate and to itself to form a dense cohesive deposit. The powder jet may be comprised of refractory metal powders. The powder may be deposited by a supersonic jet and may be extruded by Equi channel angular extrusion.

21 Claims, 4 Drawing Sheets

U.S. PATENT DOCUMENTS

| | | | | |
|---|---|---|---|---|
| 5,859,654 | A | 1/1999 | Radke et al. | |
| 5,954,856 | A | 9/1999 | Pathare et al. | |
| 5,972,065 | A | 10/1999 | Dunn et al. | |
| 5,993,513 | A | 11/1999 | Fife | |
| 6,136,062 | A | 10/2000 | Loffelholz et al. | |
| 6,139,913 | A | 10/2000 | Van Steenkiste et al. | |
| 6,171,363 | B1 | 1/2001 | Shekhter et al. | |
| 6,189,663 | B1 | 2/2001 | Smith et al. | |
| 6,197,082 | B1 | 3/2001 | Dorvel et al. | |
| 6,238,456 | B1 | 5/2001 | Wolf et al. | |
| 6,258,402 | B1 | 7/2001 | Hussary et al. | |
| 6,261,337 | B1 | 7/2001 | Kumar | |
| 6,328,927 | B1 | 12/2001 | Lo et al. | |
| 6,331,233 | B1 | 12/2001 | Turner | |
| 6,408,928 | B1 * | 6/2002 | Heinrich et al. | 164/46 |
| 6,444,259 | B1 | 9/2002 | Subramanian et al. | |
| 6,482,743 | B1 | 11/2002 | Sato | |
| 6,491,208 | B2 | 12/2002 | James et al. | |
| 6,502,767 | B2 | 1/2003 | Kay et al. | |
| 6,521,173 | B2 | 2/2003 | Kumar et al. | |
| 6,558,447 | B1 | 5/2003 | Shekhter et al. | |
| 6,589,311 | B1 | 7/2003 | Han et al. | |
| 6,669,782 | B1 | 12/2003 | Thakur | |
| 6,722,584 | B2 | 4/2004 | Kay et al. | |
| 6,749,002 | B2 | 6/2004 | Grinberg et al. | |
| 6,759,085 | B2 | 7/2004 | Muehlberger | |
| 6,770,154 | B2 | 8/2004 | Koenigsmann et al. | |
| 6,773,969 | B2 | 8/2004 | Lee et al. | |
| 6,855,236 | B2 | 2/2005 | Sato et al. | |
| 6,905,728 | B1 | 6/2005 | Hu et al. | |
| 6,911,124 | B2 | 6/2005 | Tang et al. | |
| 6,915,964 | B2 | 7/2005 | Tapphorn | |
| 6,919,275 | B2 | 7/2005 | Chiang et al. | |
| 6,924,974 | B2 | 8/2005 | Stark | |
| 6,953,742 | B2 | 10/2005 | Chen et al. | |
| 6,962,407 | B2 | 11/2005 | Yamamoto et al. | |
| 7,053,294 | B2 | 5/2006 | Tuttle et al. | |
| 7,067,197 | B2 | 6/2006 | Michaluk et al. | |
| 7,081,148 | B2 | 7/2006 | Koenigsmann et al. | |
| 7,101,447 | B2 | 9/2006 | Turner | |
| 7,108,893 | B2 | 9/2006 | Van Steenkiste et al. | |
| 7,128,988 | B2 | 10/2006 | Lambeth | |
| 7,164,205 | B2 | 1/2007 | Yamaji et al. | |
| 7,170,915 | B2 | 1/2007 | McDonald | |
| 7,175,802 | B2 | 2/2007 | Sandlin et al. | |
| 7,178,744 | B2 | 2/2007 | Tapphorn et al. | |
| 7,183,206 | B2 | 2/2007 | Shepard | |
| 7,192,623 | B2 | 3/2007 | Andre et al. | |
| 7,208,230 | B2 | 4/2007 | Ackerman et al. | |
| 7,399,335 | B2 | 7/2008 | Shekhter et al. | |
| 7,479,299 | B2 | 1/2009 | Raybould et al. | |
| 2002/0112789 | A1 | 8/2002 | Jepson et al. | |
| 2002/0112955 | A1 | 8/2002 | Aimone et al. | |
| 2003/0023132 | A1 | 1/2003 | Melvin et al. | |
| 2003/0190413 | A1 | 10/2003 | Van Steenkiste et al. | |
| 2003/0219542 | A1 | 11/2003 | Ewasyshyn et al. | |
| 2003/0232132 | A1 | 12/2003 | Muehlberger | |
| 2004/0037954 | A1 | 2/2004 | Heinrich et al. | |
| 2004/0065546 | A1 | 4/2004 | Michaluk et al. | |
| 2004/0076807 | A1 | 4/2004 | Grinberg et al. | |
| 2004/0126499 | A1 | 7/2004 | Heinrich et al. | |
| 2005/0084701 | A1 | 4/2005 | Slattery | |
| 2005/0120957 | A1 | 6/2005 | Kowalsky et al. | |
| 2005/0142021 | A1 | 6/2005 | Aimone et al. | |
| 2005/0155856 | A1 | 7/2005 | Oda | |
| 2005/0220995 | A1 | 10/2005 | Hu et al. | |
| 2005/0252450 | A1 | 11/2005 | Kowalsky et al. | |
| 2006/0021870 | A1 | 2/2006 | Tsai et al. | |
| 2006/0032735 | A1 | 2/2006 | Aimone et al. | |
| 2006/0042728 | A1 | 3/2006 | Lemon et al. | |
| 2006/0045785 | A1 | 3/2006 | Hu et al. | |
| 2006/0090593 | A1 | 5/2006 | Liu | |
| 2006/0121187 | A1 | 6/2006 | Haynes et al. | |
| 2006/0251872 | A1 | 11/2006 | Wang et al. | |
| 2007/0172378 | A1 | 7/2007 | Shibuya et al. | |
| 2007/0196570 | A1 * | 8/2007 | Gentsch et al. | 427/180 |
| 2008/0078268 | A1 | 4/2008 | Shekhter et al. | |
| 2008/0145688 | A1 | 6/2008 | Miller et al. | |
| 2008/0171215 | A1 | 7/2008 | Kumar et al. | |
| 2008/0216602 | A1 | 9/2008 | Zimmermann et al. | |
| 2008/0271779 | A1 | 11/2008 | Miller et al. | |
| 2010/0015467 | A1 | 1/2010 | Zimmermann et al. | |
| 2010/0055487 | A1 | 3/2010 | Zimmermann et al. | |
| 2010/0061876 | A1 | 3/2010 | Miller et al. | |

FOREIGN PATENT DOCUMENTS

| | | | |
|---|---|---|---|
| EP | 0 074 803 | A1 | 3/1983 |
| EP | 0484533 | A1 | 5/1992 |
| EP | 0 774 315 | A2 | 5/1997 |
| EP | 1 066 899 | A2 | 1/2001 |
| EP | 1 138 420 | A2 | 10/2001 |
| EP | 1 350 861 | A1 | 10/2003 |
| EP | 1 382 720 | A2 | 1/2004 |
| EP | 1 413 642 | A1 | 4/2004 |
| GB | 2121441 | A | 12/1983 |
| GB | 2394479 | A | 4/2004 |
| JP | 06346232 | A | 12/1994 |
| WO | WO-9837249 | | 8/1998 |
| WO | WO-0112364 | A1 | 2/2001 |
| WO | WO-02064287 | A2 | 8/2002 |
| WO | WO-03/062491 | A2 | 7/2003 |
| WO | WO-03/106051 | A1 | 12/2003 |
| WO | WO-2004074540 | A1 | 9/2004 |
| WO | WO-2005073418 | A1 | 8/2005 |
| WO | WO-2006117145 | A2 | 11/2006 |
| WO | WO-2008/089188 | A1 | 7/2008 |

OTHER PUBLICATIONS

"Cold Spray Process," Handbook of Thermal Spray Technology, ASM International, Sep. 2004, pp. 77-84.

Ajdelsztajn et al., "Synthesis and Mechanical Properties of Nanocrytalline Ni Coatings Producted by Cold Gas Dynamic Spraying," 201 Surface and Coatings Tech. 3-4, pp. 1166-1172 (Oct. 2006).

Gärtner et al., "The Cold Spray Process and its Potential for Industrial Applications," 15 J. of Thermal Sprsy Tech. 2, pp. 223-232 (Jun. 2006).

Hall et al., "The Effect of a Simple Annealing Heat Treatment on the Mechanical Properties of Cold-Sprayed Aluminum," 15 J. of Thermal Spray Tech. 2, pp. 233-238 (Jun. 2006.).

Hall et al., "Preparation of Aluminum Coatings Containing Homogeneous Nanocrystalline Microstructures Using the Cold Spray Process," JTTEES 17:352-359.

IPRP in International Patent Application No. PCT/EP2006/003967, dated Nov. 6, 2007 (15 pages).

IPRP in International Patent Application No. PCT/US2008/062434, dated Nov. 10, 2009 (21 pages).

IPRP in International Patent Application No. PCT/EP2006/003969, mailed dated Nov. 6, 2007 (13 pages).

International Search Report and Written Opinion in International Patent Application No. PCT/US2007/087214, mailed Mar. 23, 2009 (13 pages).

IPRP in International Patent Application No. PCT/US2007/081200, dated Sep. 1, 2009 (17 pages).

IPRP in International Patent Application No. PCT/US2007/080282, dated Apr. 7, 2009 (15 pages).

Irissou et al., "Review on Cold Spray Process and Technology: Part I—Intellectual Property," 17 J. of Thermal Spray Tech. 4, pp. 495-516 (Dec. 2008).

Karthikeyan, "Cold Spray Technology: International Status and USA Efforts," ASB Industries, Inc. (Dec. 2004).

Li et al., "Effect of Annealing Treatment on the Microstructure and Properties of Cold-Sprayed Cu Coating," 15 J. of Thermal Spray Tech. 2, pp. 206-211 (Jun. 2006).

Marx et al., "Cold Spraying- Innovative Layers for New Applications," 15 J. of Thermal Spray Tech. 2, pp. 177-183 (Jun. 2006).

Morito, "Preparation and Characterization of Sintered Mo-Re Alloys," 3 J. de Physique 7, Part 1, pp. 553-556 (1993).

Search Report in European Patent Application No. 09172234.8, dated Jan. 29, 2010 (7 pages).

Stoltenhoff et al., "An Analysis of the Cold Spray Process and its Coatings," 11 J. of Thermal Spray Tech. 4, pp. 542-550 (Dec. 2002).

Van Steenkiste et al., "Analysis of Tantalum Coatings Produced by the Kinetic Spray Process," 13 J. of Thermal Spray Tech. 2, pp. 265-273 (Jun. 2004).

* cited by examiner

LOW-ENERGY METHOD OF MANUFACTURING BULK METALLIC STRUCTURES WITH SUBMICRON GRAIN SIZES

PROBLEM TO BE SOLVED

Metals and metal alloys having a submicron or nanocrystalline structure are of great interest to the commercial and military segment. They have novel properties allowing for the development of completely new product opportunities. To date though, making bulk nanocrystalline materials of metals of interest has been problematic. Most of the success has occurred with thin films and sprayed coatings. Some success has been achieved with high energy milling, high deformation rate machining chips, equiangular extrusion, and easy glass formers. But these all have severe drawbacks. There is a need for a simple, cost effective means of making three dimensionally large, sub micron grain size, crystalline structures.

BACKGROUND OF INVENTION

Metallic materials having a submicron, or nanocrystalline grain structure are of great interest due to their unique properties which include extended ductility and very high yield strengths. Much work has been done with thin films, coatings, and powders to make nanocrystalline structures, but the means of making three dimensionally large structures still remains elusive.

High energy milling is probably one of the most common ways of manufacturing metal powders having a submicron size grain structure. One problem with this approach is the powder frequently becomes heavily contaminated with microscopic particles that result from the wear of the mill, attriter or grinding media used in the process Another technique pioneered by Purdue University and now being commercialized by Nanodynamics Inc. involves compacting machining chips created at high deformation rates. The cold work induced in the machining process results in nanocrystalline grain sizes in the chips. Like high energy milling this technique suffers contamination from the machining process and also requires the use of expensive secondary operations (Hot Isostatic Pressing, extrusion, explosive compaction, etc.) to consolidate the loose powder or chips into a bulk solid. Many times, if not carefully controlled, this secondary processing can damage the initial microstructure during consolidation.

Equi-channel angular extrusion (ECAE) is a high shear process where the metal or alloy is forced through a die changing the direction of flow. Very high strains are produced resulting in grain size refinement. However, the metal may have to be passed through the die multiple times (3-4) to produce a submicron grain size making the process work and cost intensive.

Others such as A. C. Hall, L. N. Brewer and T. J. Roemer, "Preparation of Aluminum coatings Containing Homogeneous Nanocrystalline Microstructures Using the cold Spray Process", *JTTEES* 17:352-359 have shown that thin coatings made from submicron grain sized powders retain this submicron grain size when the coatings are made by cold spray. In certain instances with aluminum they have even reduced the submicron grain size.

SUMMARY OF INVENTION

We have discovered that certain metal powders of conventional grain size, substantially 5-10 microns and even larger, when projected at supersonic velocity, at relatively low temperature and deposited on a substrate form a dense solid having a submicron grain structure. This deposit can be made large in all three dimensions and the substrate easily removed to leave only the nanocrystalline deposit. This deposit differs from coatings in that refractory metal coatings are typically less than 0.5 mm thick, usually less than 0.1 mm and rely on remaining attached to the substrate to maintain their physical integrity. In this case the thickness dimension can be quite large up to 1-2 cm and beyond. The large thickness allows the deposit to be removed from the substrate and used in free standing applications.

We have demonstrated this behavior for Ta, Nb and Mo metals (all BCC structure and having a high melting point temperature), and believe it may be a universal phenomena that is velocity sensitive.

THE DRAWINGS

DETAILED DESCRIPTION

Figure 1:
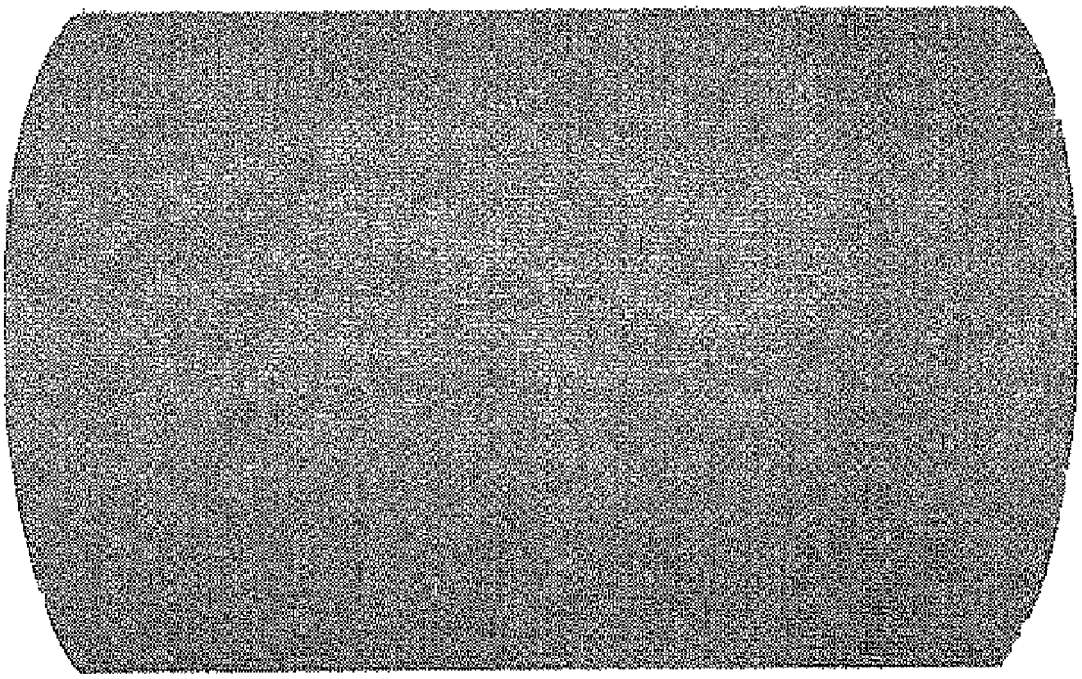
FIG. 1 shows a tubular tantalum perform made by cold spray.

What we have discovered is a process for making three dimensionally large structures having a submicron grain structure. This submicron grain structure is also resistant to growth during processing at elevated temperatures which can be used to improve interparticle bond strength, eliminate work hardening and improve ductility. Additionally these deposits can be used as a starting material for ECAE processing reducing the number of passes required to 1 to develop a fully densified, fine, uniform structure.

In general, the process for producing three dimensionally large metallic structures comprised of submicron range sizes includes directing a supersonic powder jet against a substrate such that the powder adheres to the substrate and to itself to form a dense cohesive deposit. As a result products could be made from such deposits including, but not limited to, explosively formed projectiles, kinetic energy penetrators and hydrogen membranes. In the process the powdered jet may be comprised of refractory metal powders. The dense metal structure made from metal powders having a submicron grain size micro structure could thereby be useful as a refractory metal structure. The invention can be practiced where the powder is deposited by a supersonic jet and extruded by Equi channel angular extrusion. The deposit can remain attached to the substrate or could be removed from the substrate.

The invention could be practiced using a known cold spray system where, for example, a heated gas, such as nitrogen, is used to accelerate the powder and make a supersonic powder jet which is then directed against a substrate. When the supersonic powder jet is directed against the substrate and the powder adheres to the substrate and to itself, the resultant dense cohesive deposit results in a three dimensionally large metallic structure comprised of submicron grain sizes.

Experimental

The results shown below were all attained using a Kinetics 4000 cold spray system. This is a standard commercially available system. In general, a cold spray process comprises directing on a target a gas flow wherein the gas flow forms a gas-powder mixture with a powder. A supersonic speed is imparted to the gas flow. The jet of supersonic speed is directed onto the surface of a substrate thereby cold spraying the substrate. PCT application U.S. 2008/062434 discloses cold spray techniques. All of the details of that application are incorporated herein by reference thereto. In a practice of this invention heated nitrogen gas at temperatures of 500-800 C and approximately 30 bars was used to accelerate the powder and make a supersonic powder jet. The jet was typically directed against a copper or steel substrate. The substrate was usually cylindrical, cylinder like or planar in nature. Tubular, bowl like and flat disks and rectangles were made. Metallographic samples were cut from the shapes and mechanically polished. The microstructure was examined using a FIB SEM in both secondary and back scatter mode. Special high purity tantalum, niobium and molybdenum powders made by HC Starck for cold spray applications were used in these experiments.

FIG. 1 shows a tubular tantalum preform made by cold spray. The preform is approximately 150 mm long, 85 mm outside diameter with a 14 mm wall thickness and weighs 8.8 Kg. It is an example of a three dimensionally large structure.

Figure 2:
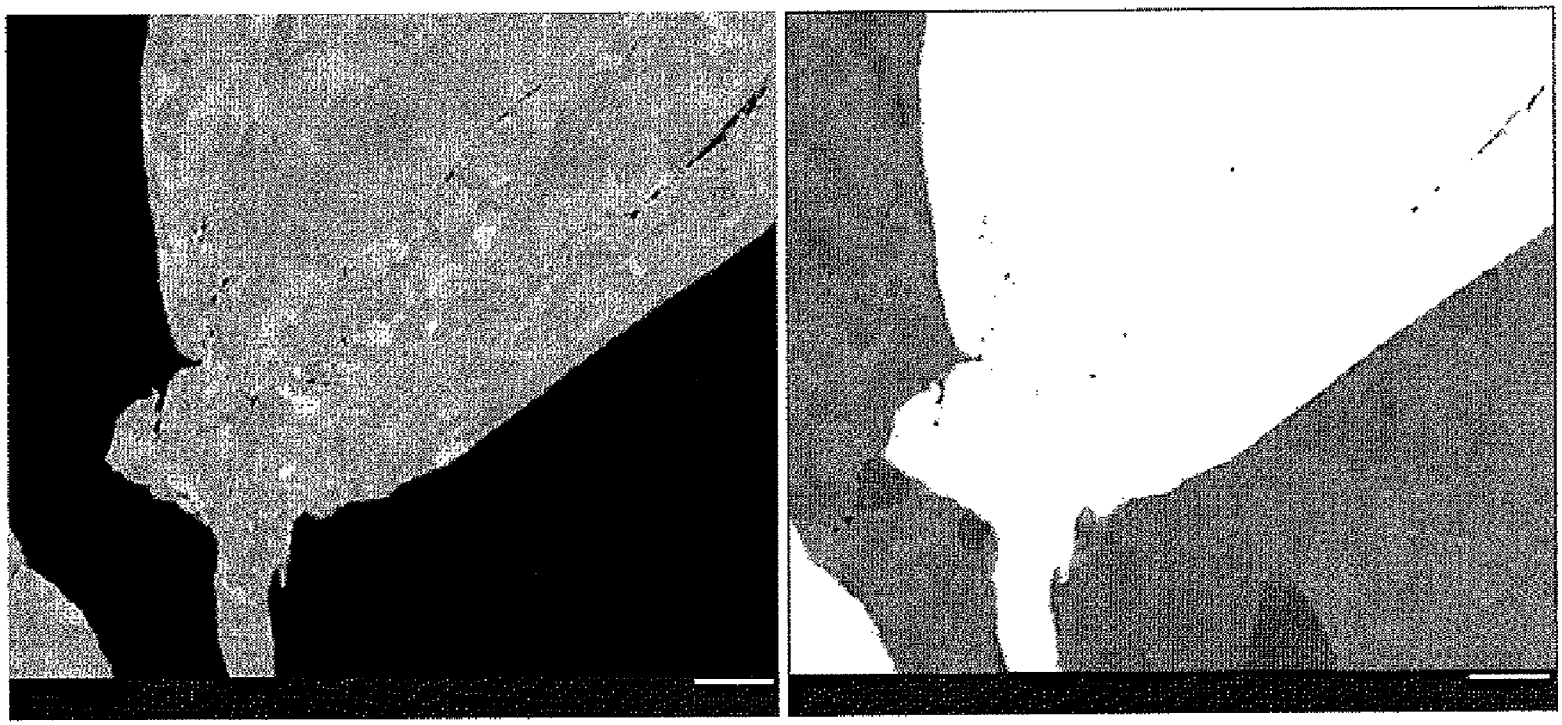
FIG. 2 is an SEM micrograph of TaNb composite taken from a sputtering target made by cold spray.

FIG. 2 is an SEM micrograph of TaNb (50/50 w/o) composite taken from a sputtering target made by cold spray. The Ta appears as the light phase and the Nb as the dark phase. The left side of the figure has the brightness and contrast adjusted to reveal the details of the Ta microstructure, while the right side is adjusted to reveal the Nb microstructure. Near the surface of the Ta powder particle it is clear the microstructure is highly refined comprising of grains typically less than 400-500 nanometers. Moving to the interior the structure becomes more diffuse. We believe this is due to the gradient in strain produced from the outside of the particle to the inside, because the interior undergoes less deformation. This gradient can be eliminated simply by the use of finer powder and perhaps even higher particle velocities. The right side of the micrograph shows the microstructure of the surrounding Nb. While many of the grains are still submicron in size it is clear the degree of refinement is significantly less than what occurred in the Ta. FIG. 2 includes at the bottom of both the left side and the right side of the figure a bar which represents a one micron marker.

Figure 3:
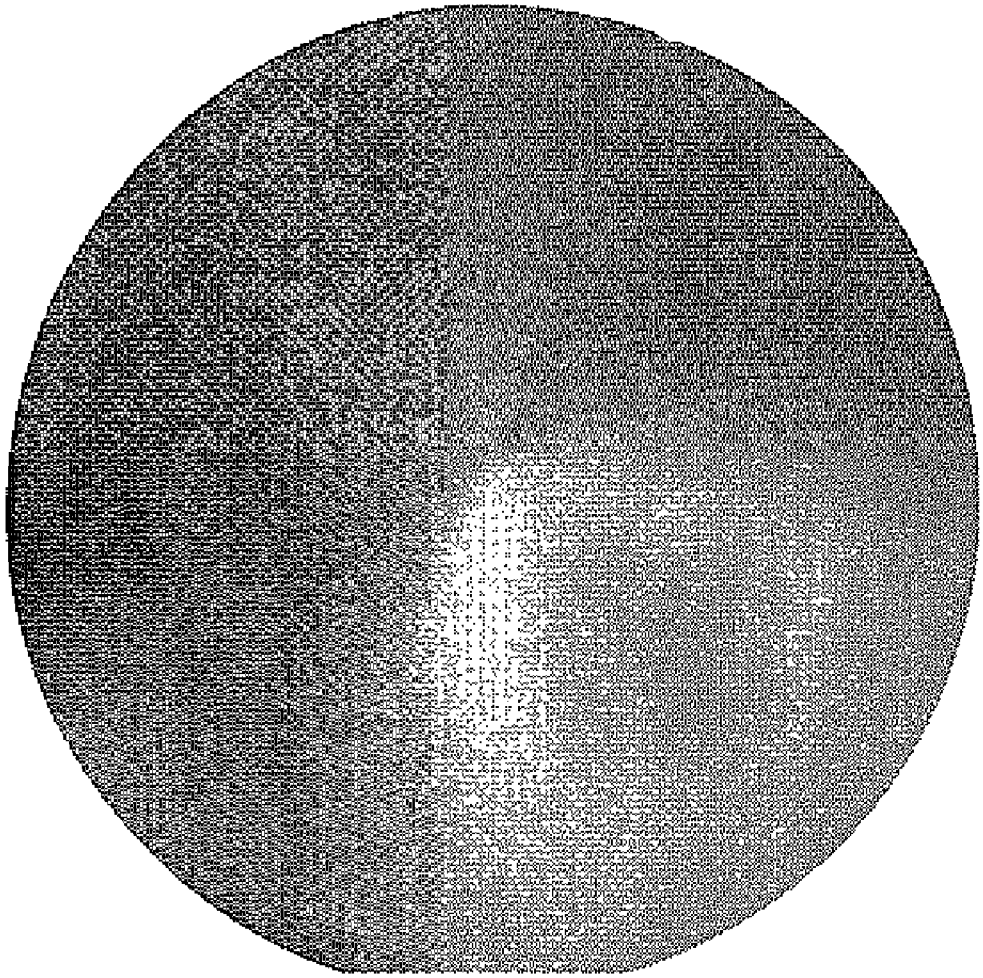
FIG. 3 is a microphotograph of a MoTi sputtering target.

FIG. 3 is a macrophotograph of a MoTi (67/33 w/o) 125 mm diameter sputtering target. Like FIG. 1 this just demonstrates the potential for cold spray to make large, free standing objects.

Figure 4:
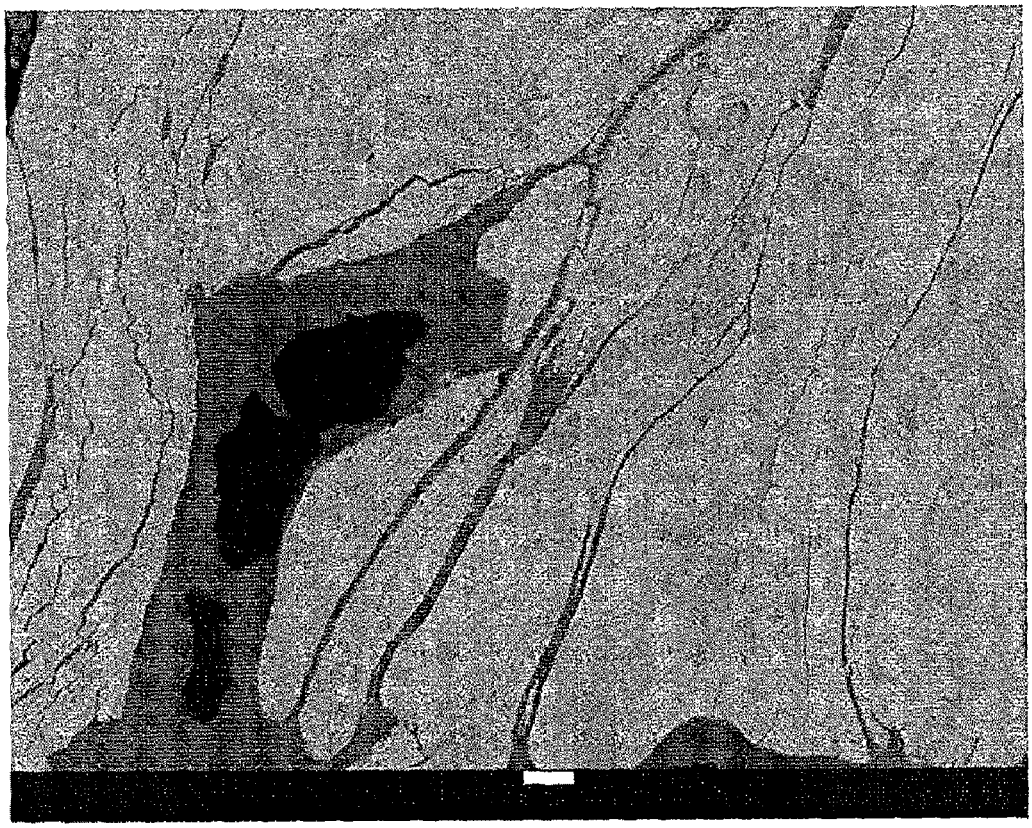
FIG. 4 is a SEM magnification micrograph of a cold sprayed MoTi specimen.

FIG. 4 is a high magnification micrograph of a cold sprayed MoTi specimen. The specimen has been vacuum annealed at 700 C for 1 and ½ hours. The light phase is Mo, the dark phase is Ti. In the Mo the grain size is in the order of 500 nanometer while in the Ti the grains have grown to be approximately a micrometer in size. FIG. 4 illustrates a centrally located bar at the bottom of the figure which represents a one micron marker.

What is claimed is:

1. A process for producing three dimensionally large metallic structures having submicron grain sizes, the process comprising:

using a cold spray system, accelerating a metal powder having a grain size larger than 5 microns with a heated gas, thereby forming a supersonic metal powder jet; and directing the supersonic metal powder jet against a substrate, the powder adhering to the substrate and to itself to form a dense cohesive deposit having a submicron grain structure and a thickness larger than 0.5 mm, thereby forming the three dimensionally large metallic structure, the three dimensionally large metallic structure being a product selected from the group consisting of explosively formed projectiles and kinetic energy penetrators and hydrogen membranes.

2. The process of claim 1 wherein the powder jet comprises at least one refractory metal powder.

3. The process of claim 2, wherein the three dimensionally large metallic structure produced is a refractory metal structure.

4. A process for producing three dimensionally large metallic structures having submicron grain sizes, the process comprising:

using a cold spray system, accelerating a metal powder having a grain size larger than 5 microns with a heated gas, thereby forming a supersonic metal powder jet;

directing the supersonic metal powder jet against a substrate, the powder adhering to the substrate and to itself to form a dense cohesive deposit having a submicron grain structure and a thickness larger than 0.5 mm, thereby forming the three dimensionally large metallic structure; and extruding the deposit by Equi channel angular extrusion.

5. The process of claim 1 wherein after the deposit is formed, it is maintained attached to the substrate.

6. The process of claim 1 further comprising separating the substrate and the deposit from each other.

7. The process of claim 1 further comprising annealing the deposit to at least one of increase interparticle bonding, increase ductility, or decrease work hardening.

8. The process of claim 1 wherein the powder is selected from the group consisting of tantalum, niobium, and molybdenum.

9. The process of claim 1 wherein the deposit has a grain size less than 500 nanometers.

10. The process of claim 1 wherein the deposit has a grain size less than 400 nanometers.

11. The process of claim 1 wherein the heated gas comprises nitrogen at a temperature between 500° C. and 800° C.

12. The process of claim 1 wherein the thickness of the deposit is larger than approximately 1 cm.

13. The process of claim 4 wherein the metal powder comprises at least one refractory metal powder.

14. The process of claim 4 wherein after the deposit is formed, it is maintained attached to the substrate.

15. The process of claim 4 further comprising separating the substrate and the deposit from each other.

16. The process of claim 4 wherein the three dimensionally large metallic structure produced is a product selected from the group consisting of explosively formed projectiles and kinetic energy penetrators and hydrogen membranes.

17. The process of claim 4 further comprising annealing the deposit to at least one of increase interparticle bonding, increase ductility, or decrease work hardening.

18. The process of claim 4 wherein the powder is selected from the group consisting of tantalum, niobium, and molybdenum.

19. The process of claim 4 wherein the deposit has a grain size less than 500 nanometers.

20. The process of claim 4 wherein the deposit has a grain size less than 400 nanometers.

21. The process of claim 4 wherein the heated gas comprises nitrogen at a temperature between 500° C. and 800° C.

* * * * *